US010381122B2

(12) United States Patent
Downey

(10) Patent No.: US 10,381,122 B2
(45) Date of Patent: Aug. 13, 2019

(54) SYSTEM FOR NUCLEAR WASTE STORAGE AND MONITORING

(71) Applicant: M Downey Exploration LLC, Dallas, TX (US)

(72) Inventor: Marlan Downey, Dallas, TX (US)

(73) Assignee: MWD-IP Holdings, LLC, Dallas, TX (US)

( * ) Notice: Subject to any disclaimer, the term of this patent is extended or adjusted under 35 U.S.C. 154(b) by 0 days.

(21) Appl. No.: 16/103,269

(22) Filed: Aug. 14, 2018

(65) Prior Publication Data

US 2018/0350479 A1 Dec. 6, 2018

Related U.S. Application Data

(62) Division of application No. 15/480,909, filed on Apr. 6, 2017, now Pat. No. 10,115,490.

(51) Int. Cl.

| | |
|---|---|
| ***E21B 7/04*** | (2006.01) |
| ***G21F 9/34*** | (2006.01) |
| ***G21F 9/00*** | (2006.01) |
| ***E21B 49/00*** | (2006.01) |
| ***E21B 47/06*** | (2012.01) |
| ***E21B 41/00*** | (2006.01) |
| ***E21B 33/13*** | (2006.01) |
| *E21B 33/12* | (2006.01) |
| *E21B 37/00* | (2006.01) |
| *E21B 29/00* | (2006.01) |

(52) U.S. Cl.

CPC ..... *G21F 9/34* (2013.01); *E21B 7/04* (2013.01); *E21B 33/13* (2013.01); *E21B 41/005* (2013.01); *E21B 47/06* (2013.01); *E21B 47/065* (2013.01); *E21B 49/00* (2013.01); *G21F 9/008* (2013.01); *E21B 29/00* (2013.01); *E21B 33/12* (2013.01); *E21B 37/00* (2013.01)

(58) Field of Classification Search

CPC ..... E21B 7/07; E21B 33/13; E21B 41/005; E21B 47/06; G21F 9/34; G21F 9/008

USPC ..... 588/17

See application file for complete search history.

(56) References Cited

U.S. PATENT DOCUMENTS

| | | | |
|---|---|---|---|
| 5,489,740 | A | 2/1996 | Fletcher |
| 5,850,641 | A | 12/1998 | Crichlow |
| 5,863,283 | A | 1/1999 | Gardes |
| 8,693,609 | B2 | 4/2014 | Foppe |
| 8,933,289 | B2 | 1/2015 | Crichlow |
| 2010/0223988 | A1 | 9/2010 | Crow et al. |
| 2013/0077728 | A1 | 3/2013 | Scaglione et al. |
| 2015/0184354 | A1 | 7/2015 | Carter, Jr. |
| 2017/0186505 | A1 | 6/2017 | Muller et al. |

FOREIGN PATENT DOCUMENTS

| | | | |
|---|---|---|---|
| DE | 19528496 | C1 | 10/1996 |
| EP | 2975615 | A1 | 1/2016 |
| RU | 2075357 | C1 | 3/1997 |
| WO | 9522150 | A1 | 8/1995 |
| WO | 2008032018 | A3 | 3/2008 |
| WO | 2017112479 | A1 | 6/2017 |

OTHER PUBLICATIONS

"A Review of the Deep Borehole Disposal Concept for Radioactive Waste"; Nirex Report No. N/108; United Kingdom Nirex Limited; Jun. 2004; 89 pgs.

Brady, et al.; "Deep Borehole Disposal of High-Level Radioactive Waste"; SAND2009-4401; Sandia National Laboratories; Jul. 2009; pp. 1-75.

Driscoll; "A Case for Disposal of Nuclear Waste in Deep Boreholes"; Massachusetts Institute of Technology; Mar. 2010; pp. 1-13.

"Drilled Shafts: Construction Procedures and LRFD Design Methods"; U.S. Department of Transportation, Federal Highway Administration; NHI Course No. 132014; May 2010; 972 pgs.

Arnold, et al.; "Reference Design and Operations for Deep Borehole Disposal of High-Level Radioactive Waste"; Sandia National Laboratories; Sandia Report 2011-6749; Oct. 2011; pp. 1-66.

Conca; "Can't We Just Throw Our Nuclear Waste Down a Deep Hole?"; Mar. 5, 2015; 1 pg.

Muller, et al.; "Horizontal Boreholes in Shale for Deep Isolation of Spent Nuclear Fuel", The Geological Society of America; GSA Annual Meeting in Denver, CO; 2016; 1 pg.

"Deep borehole disposal"; Wikipedia; Oct. 13, 2016; pp. 1-2.

Turner; "A 1000,000-Year Grave for Nuclear Waste"; The Wall Street Journal; Jan. 26, 2017; p. A20.

*Primary Examiner* — Edward M Johnson

(57) ABSTRACT

A system for storing and monitoring nuclear waste. The system includes a storage borehole having an end segment configured to store nuclear waste in a subterranean storage site location having a shale rock layer. The layer has a measured fluid overpressure in a range corresponding to greater than hydrostatic pressure to less than a lithostatic pressure from overlying rock layers. The system also includes a monitoring borehole configured to reside in the layer with an end segment of the monitoring borehole in a vicinity of the end segment of the storage borehole. The measured fluid pressure at the end of the monitoring borehole is in the fluid overpressure range.

18 Claims, 5 Drawing Sheets

SYSTEM FOR NUCLEAR WASTE STORAGE AND MONITORING

CROSS-REFERENCE TO RELATED APPLICATION

Figure 1:
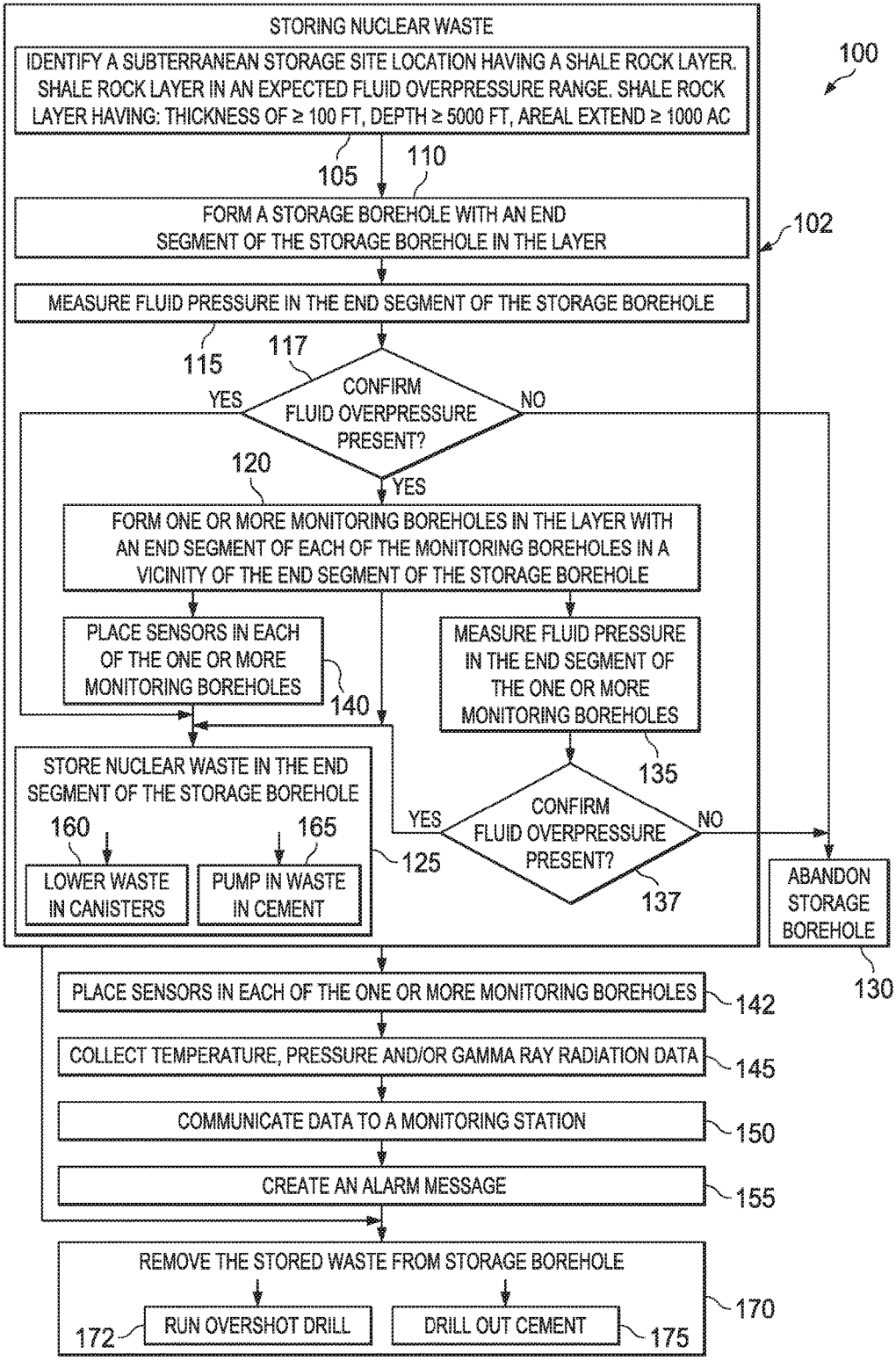

This application is a divisional of U.S. application Ser. No. 15/480,909, filed on Apr. 6, 2017, entitled "METHOD AND SYSTEM FOR NUCLEAR WASTE STORAGE AND MONITORING," by Marlan Downey, currently allowed and commonly assigned with this application and fully incorporated herein by reference.

TECHNICAL FIELD

This application is directed, in general, to waste storage, and more specifically, systems and methods of subterranean nuclear waste storage and monitoring.

BACKGROUND

Long-term storage of hazardous wastes, especially nuclear waste, is made difficult by the general requirements that the waste material be contained safely, and immobile, for thousands of years. Many different types of underground formations, e.g., clay, shale, salt; granite rock layers, have been suggested as sites that may be suitable long-term (e.g., for hundreds or thousands of years) subterranean storage locations.

SUMMARY

One embodiment of the disclosure is a system for storing and monitoring nuclear waste. The system comprises a storage borehole having an end segment configured to store nuclear waste in a subterranean storage site location having a shale rock layer. The layer has a measured fluid overpressure in a range corresponding to greater than hydrostatic pressure to less than a lithostatic pressure from overlying rock layers. The system also comprises a monitoring borehole configured to reside in the layer with an end segment of the monitoring borehole in a vicinity of the end segment of the storage borehole. The measured fluid pressure at the end of the monitoring borehole is in the fluid overpressure range.

Another embodiment is a waste storage method comprising storing nuclear waste. Storing the waste can include identifying a subterranean storage site location having a shale rock layer. The layer has an expected fluid overpressure in a range corresponding to greater than hydrostatic pressure to less than lithostatic pressure from overlying rock layers. Storing the waste can include forming a storage borehole, with an end segment of the storage borehole located within the layer and measuring the fluid pressure in the end segment of the storage borehole. If the measured fluid pressure in the end segment of the storage borehole is in the expected fluid overpressure range, forming a monitoring borehole in the layer with an end segment of each of the monitoring boreholes being in a vicinity of the end segment of the storage borehole and storing nuclear waste in the end segment of the storage borehole.

BRIEF DESCRIPTION

Figure 2:
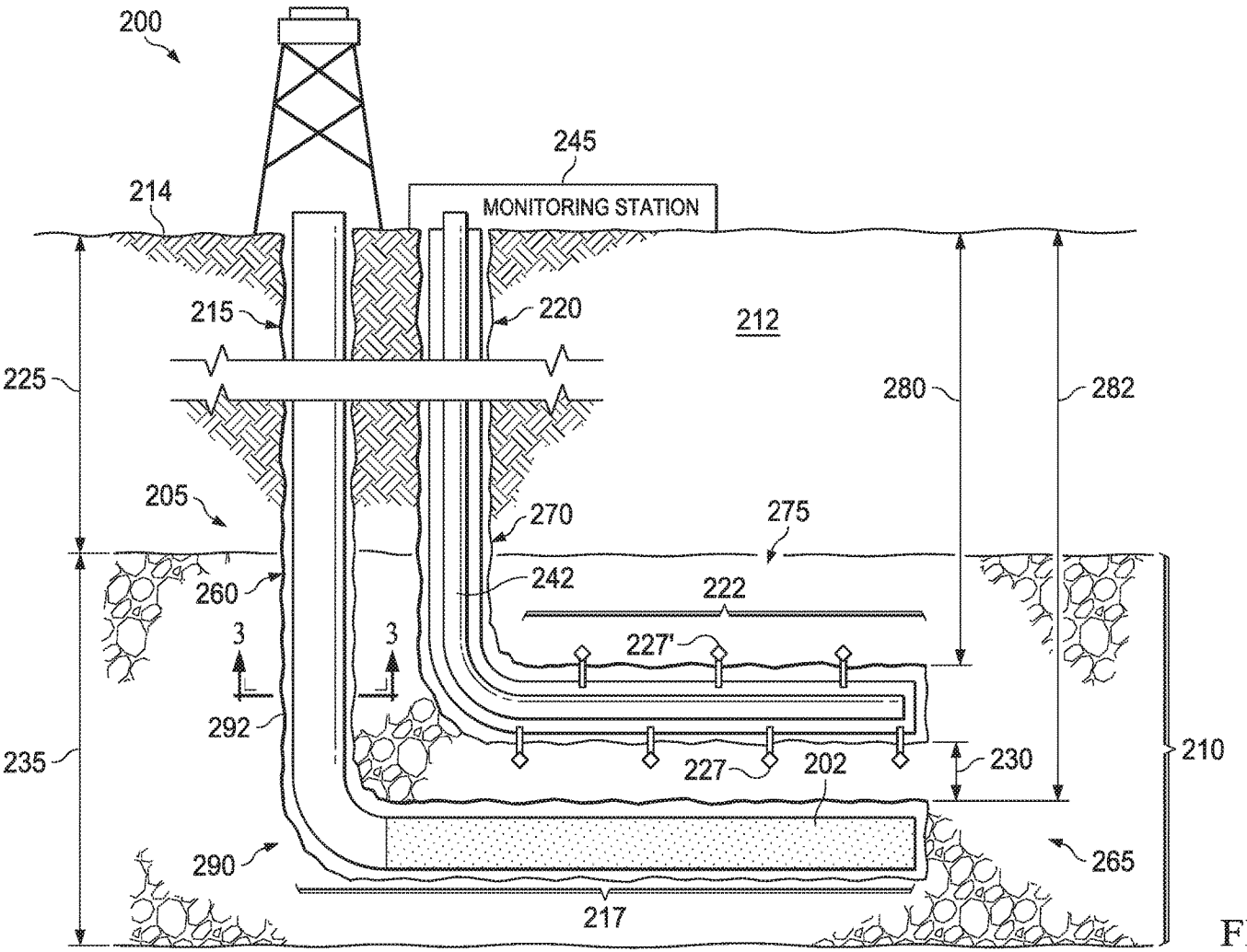
Figure 3:
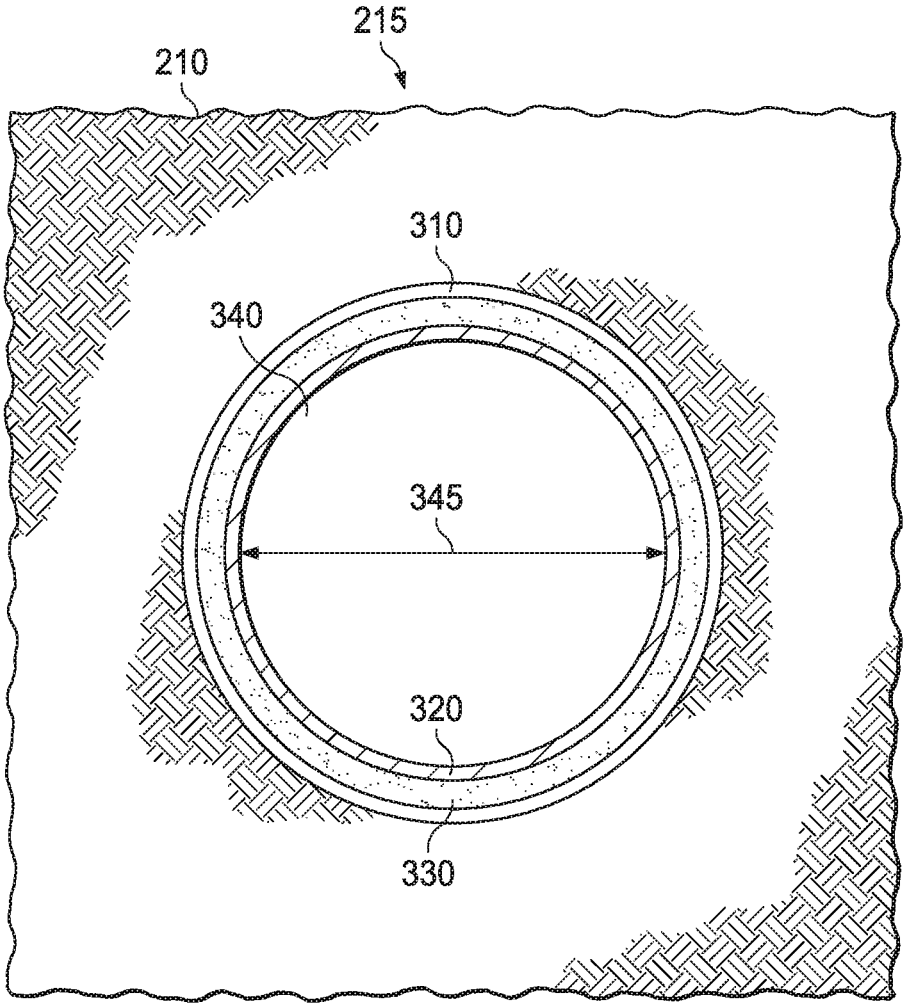
Figure 4:
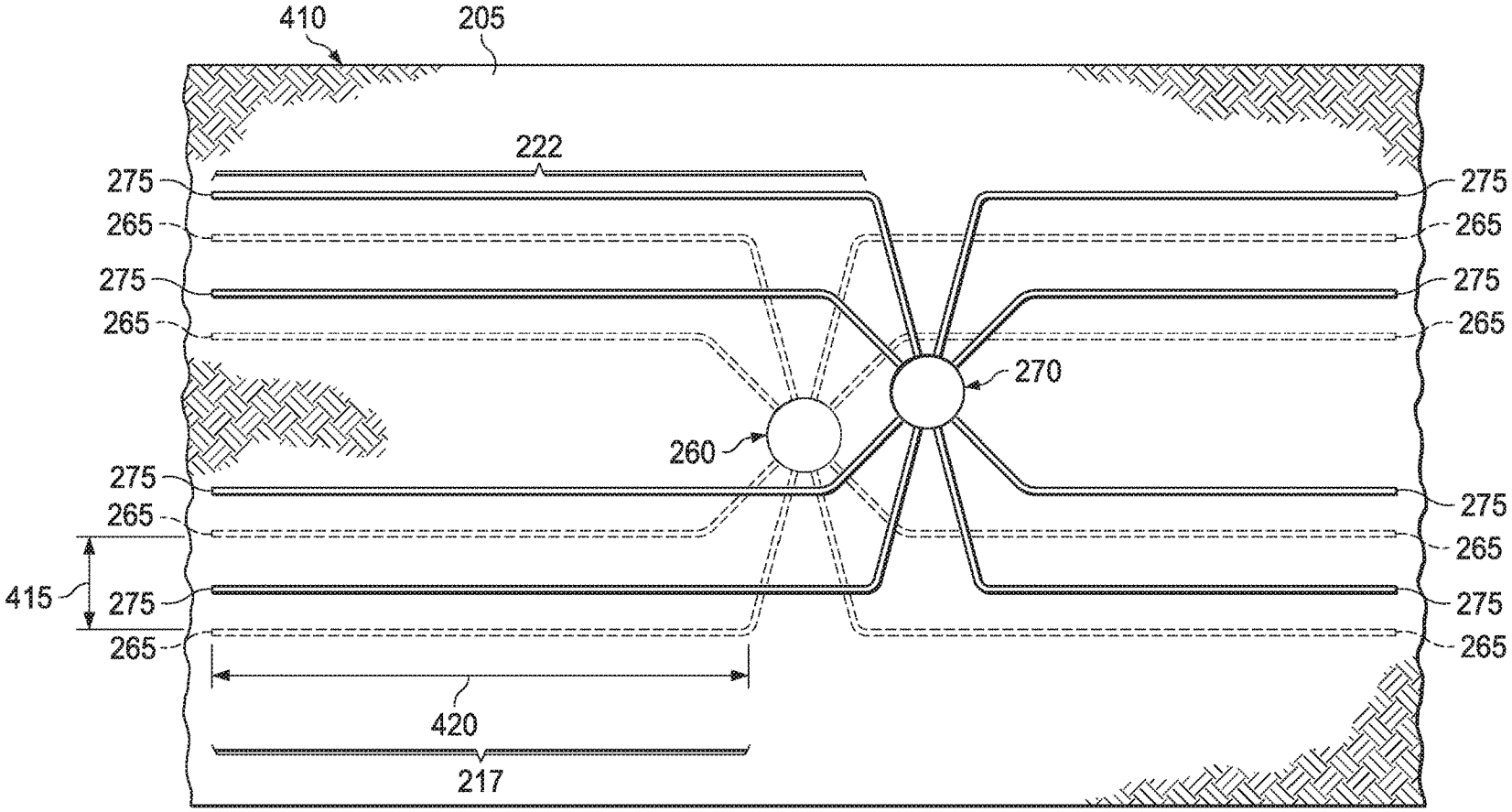
Figure 5:
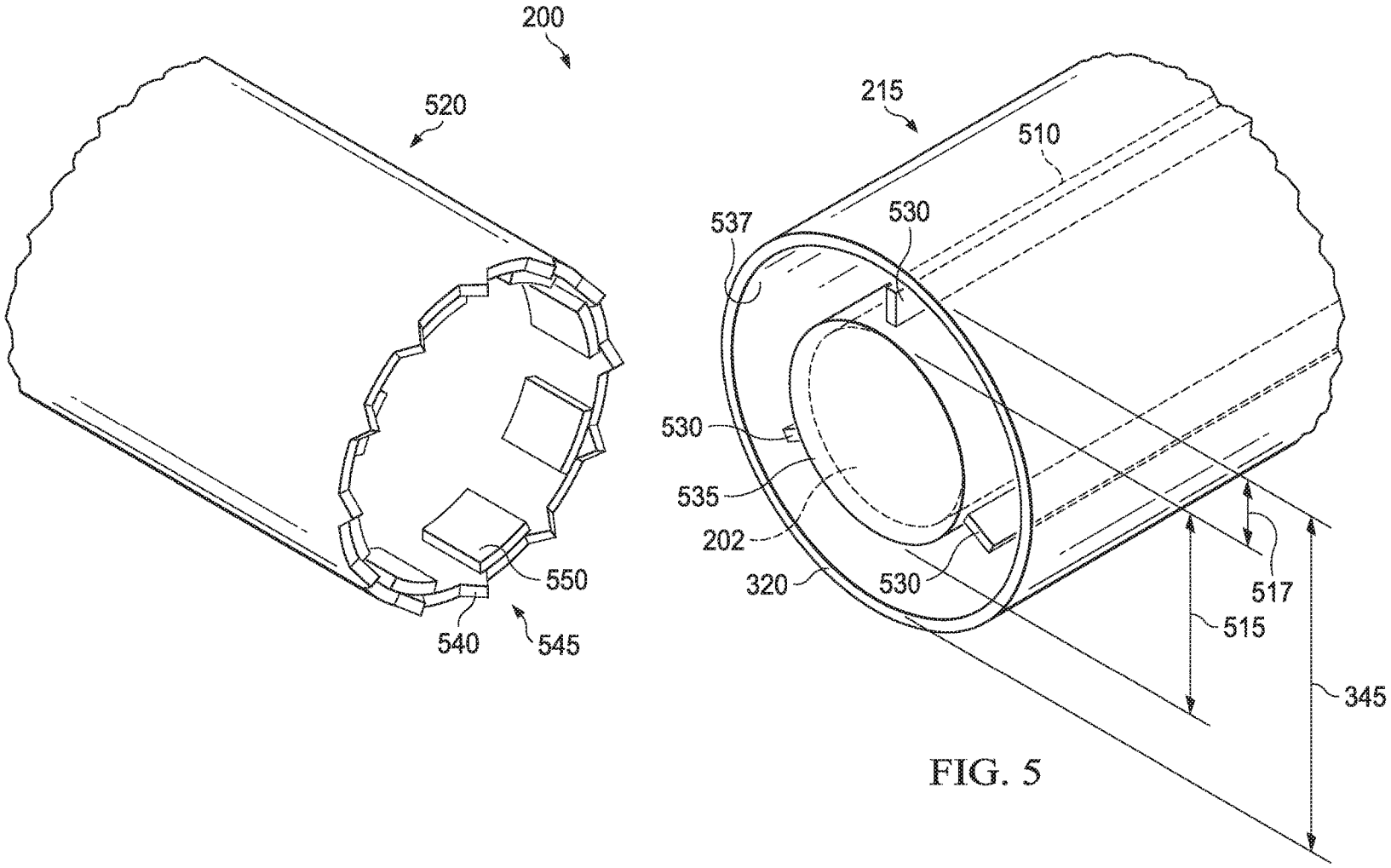

The embodiments of the disclosure are best understood from the following detailed description, when read with the accompanying FIGUREs. Some features in the figures may be described as, for example, "top," "bottom," "vertical" or "lateral" for convenience in referring to those features. Such descriptions do not limit the orientation of such features with respect to the natural horizon or gravity. Various features may not be drawn to scale and may be arbitrarily increased or reduced in size for clarity of discussion. Reference is now made to the following descriptions taken in conjunction with the accompanying drawings, in which:

FIG. 1 presents a flow diagram of an example embodiment of a waste storage method in accordance with the disclosure;

FIG. 2 presents a sectional side view of an example embodiment of a waste storage system in accordance with the disclosure;

FIG. 3 presents a cross-sectional view of an example storage borehole embodiment of the waste storage system similar to the system disclosed in the context of FIG. 2;

FIG. 4 presents an overhead plan view an example waste storage system similar the system disclosed in the context of FIG. 2; and FIG. 5 presents a perspective view of an example storage canister and overshoot drill to remove waste from of the waste storage system, similar to the system disclosed in the context of FIG. 2.

DETAILED DESCRIPTION

Embodiments of the present disclosure benefit from my recognition that, when selecting a subterranean site for the long-term storage or disposal of hazardous wastes, it is not enough to rely upon calculated or estimated average properties of the candidate site. Rather, it must be demonstrated that the subterranean site actually has suitable geophysical and geochemical properties to ensure that the hazardous material will be contained in the site, even if there is leakage from a waste storage receptacle buried at the site.

Just like the enclosing surface materials of spacesuits or submarines are individually tested for suitable containment before use, so too should the containment properties of any individual candidate subterranean site be demonstrated before storing waste at the site. Moreover, once a subterranean site has been selected, methods and systems should be in place to monitor the site to confirm that the properties which made the site suitable for hazardous wastes storage or disposal still apply and/or confirm that the site has not been disturbed.

As further described herein, embodiments of the disclosure include methods and systems to identify and demonstrate the desired properties of a candidate subterranean hazardous waste storage or disposal site and to monitor the site's properties after being selected to store waste.

FIG. 1 presents a flow diagram of an example embodiment of a waste storage method 100, and, FIG. 2 presents a sectional side view of an example embodiment of a waste storage system 200, both in accordance with the disclosure.

With continuing reference to FIGS. 1 and 2 throughout, the example method 100 comprises storing nuclear waste 202 (step 102). Storing the nuclear waste 202 (step 102) includes identifying a subterranean storage site location 205 having a shale rock layer 210 (step 105). The layer 210 is to have an expected (or target) fluid overpressure in a range corresponding to greater than hydrostatic pressure to less than a lithostatic pressure from an overlying rock layers 212 (e.g., one or more rock formation layers 212 from the earth's surface 214 to the shale rock layer 210). Storing the nuclear waste 202 (step 102) also includes forming a storage borehole 215 (step 110), with an end segment 217 of the storage borehole 215 being located within the shale rock layer 210.

Storing the nuclear waste 202 (step 102) also includes measuring the fluid pressure in the end segment 217 of the storage borehole 215 (step 115). If it is determined that the measured fluid pressure in the end segment 217 of the storage borehole 215 is in the expected fluid overpressure range (e.g., the affirmative in confirmation decision step 117), forming a monitoring borehole 220 (e.g., one or more monitoring boreholes 220) in the layer 210 (step 120), with an end segment 222 of the monitoring borehole 220 (or each of the monitoring boreholes 220) being in a vicinity of the end segment 217 of the storage borehole, and, storing nuclear waste 202 in the end segment 217 of the storage borehole (step 125). In some embodiments, the monitoring borehole(s) 220 can be formed (step 120) before storing the nuclear waste 202 (step 125), e.g., so that fluid over pressure at the monitoring borehole 220 can be confirmed. However, in other embodiments, the monitoring borehole(s) 220 can be formed (step 120) after storing the nuclear waste 202 (step 125).

Alternatively, if it is determined (e.g., the negative in confirmation decision step 117) that the measured fluid pressure in the end segment 217 of the storage borehole 215 is not in the expected fluid overpressure range, then the storage borehole 215 is abandoned (step 130) and the monitoring borehole(s) 220 are not formed and the nuclear waste is not stored in accordance with steps 120 and 125.

Herein, it should be understood that any statements made about aspects of a single monitoring borehole 220 are equally applicable to a plurality of such monitoring boreholes 220.

In some embodiments of the method 100, the storing of nuclear waste 202 in the end segment 217 of the storage borehole 215 (step 125) is further not done until after measuring the fluid pressure in the end segment 222 of the monitoring borehole 220 (or one or more monitoring boreholes 220) (step 135) and then, confirming (e.g., the affirmative of confirmation decision step 137) the measured fluid pressure in the end segment 222 of the monitoring borehole 220 (or each one of the one or more monitoring boreholes 220) are found to be in the expected fluid overpressure range. Confirming that fluid overpressure exists in the rock formation surrounding the monitoring borehole(s) 220 and in the vicinity of the storage borehole 215 can provide additional assurances that the layer 210 has the desired fluid overpressure range and that the rock formation of the layer 210 has not been disturbed by forming the monitoring borehole(s) 220.

Alternatively, if it is determined (e.g., the negative in confirmation decision step 137) that the measured fluid pressure in the end segment 222 the monitoring borehole 220 (or of each of the one or more monitoring boreholes 220) is not in the fluid overpressure range, then the storage borehole 215 can be abandoned (step 130) and the nuclear waste 202 is not stored in accordance with step 125.

The term hydrostatic pressure as used herein refers to the normal increase in fluid pressure at increasing depths from the earth's surface due to the force of gravity. Typically the weight of a 1 inch square column of water increase at a rate of about 2.96 kPa (0.43 psi) per 0.305 m (foot) depth (with some variation due to variations in the salinity of the fluid in the layer 210), in proportion to a depth measured from the earth's surface because of the increasing weight of the water exerting a downward force from above the depth.

The term lithostatic pressure as used herein refers to a confining pressure due the stress imposed on the underground layer (e.g., the shale rock layer) by the weight of overlying rock formation layers 212. Typically the lithostatic pressure can not exceed about 6.89 kPa (1 psi) per 0.305 m (foot) depth as even higher pressures would lift the overlying rock layers 212.

In some method 100 and system 200 embodiments, the measured fluid overpressure of the shale rock layer 210, including rock formations of the layer 210 surrounding the end segment 217 of the storage borehole 215 and/or the end segment 222 of the monitoring borehole 220 within the layer 210, is a value in a range corresponding to between about 2.96 kPa and about 6.89 kPa per 0.305 m depth (about 0.43 and about 1 psi per foot depth). In some embodiments, to have greater assurance that the layer has the desired fluid overpressure range, the layer 210 is selected for the subterranean storage site location 205 when the measured fluid overpressure value is in a range corresponding to about 3.44 kPa and 5.51 kPa per 0.305 m depth (about 0.5 to 0.8 psi/foot depth) and in some embodiments, a range corresponding to about 4.13 kPa to 4.83 kPa per 0.305 m depth (about 0.6 to 0.7 psi/foot depth). In some embodiments, for example, a fluid overpressure of greater than 5.51 kPa per 0.305 m (0.8 psi/foot) depth the layer 210 may be unstable for drilling. In some embodiments, for example, a fluid overpressure of less than 3.44 kPa per 0.305 m (0.5 psi/foot) depth may give less assurance of the layer 210 having continuing fluid overpressure values sufficient to confine the waste 202 for long periods (e.g., thousands of years).

For example, in some embodiments, for a shale rock layer 210 at a depth 225 of 5000 feet, to confirm identification of the location (e.g., the location identified as part of step 105) as a suitable subterranean waste storage site location 205, the measured fluid overpressure value is in a range between about 14824 kPa (about 2150 psi) and about 34474 kPa (about 5000 psi) and, in some embodiments, more preferably a fluid pressure value in a range from about 18960 kPa (about 2750 psi) to about 27579 kPa (about 4000 psi). Or, for a shale rock layer 210 at a depth 225 of 3048 m (10,000 feet), in order to be identified as a suitable subterranean waste storage site location, the measured fluid overpressure is a value in a range between about 29647 kPa (about 4300 psi) and 68947 kPa (about 10000 psi) and, in some embodiments, more preferably a fluid pressure value in a range from about 37921 kPa (about 5500 psi) to about 55158 kPa (about 8000 psi).

As described in further detail elsewhere herein, the monitoring borehole 220 formed in the vicinity of the storage borehole 215 (e.g., as part of step 120) can be provisioned with various types of sensors 227 separated from the storage borehole 215, but, in close enough proximity (i.e., in the vicinity) to the storage borehole 215 to provide information about the physical properties of the storage borehole. It is desirable to not locate any monitoring borehole 220 too close to the storage borehole 215 that the forming of the monitoring borehole 220 risks disturbing the rock formation of the layer 210 surrounding the storage borehole 215. For instance, the end segment 222 of the monitoring borehole 220 can be located in a vicinity of the end segment 217 of the storage borehole 215 so that the sensors 227 placed from the monitoring borehole 220 can record timely information about the properties of the rock formation surrounding the end segment 217 of the storage borehole 215. For example the farther away the monitoring borehole 220 is from the storage borehole 215 then longer time it may take for changes environmental data (e.g., pressure, temperature or radioactivity data) to reach the sensors 227 or the extent of change in the data is dampened. However, the vicinity of the monitoring borehole 220 is selected to be far enough away as to not disturb the rock formation surrounding the end segment of storage borehole 215 when the monitoring borehole is formed.

For example in some embodiments, the end segment 222 of the monitoring borehole 220 is selected to be in the vicinity of the end segment 217 of the storage borehole 215 when an outer perimeter of the monitoring borehole to an outer perimeter of the storage borehole has a separation distance 230 in a range from about 1.52 m (about 5 feet) to about 305 m (about 1000 feet) and in some embodiments, a range from 3.05 m (about 10) feet to about 30.5 m (about 100 feet). As illustrated in FIG. 2, typically for the entire length of the end segment 222 of the monitoring borehole 220 to be in the vicinity (i.e., within the separation distance 230) of the storage borehole 215 the monitoring borehole 220 runs parallel to the storage borehole 215, or at least, the end segment 222 runs parallel to the end segment 217 of the storage borehole 215.

In some embodiments of the method 100, the identification the subterranean storage site location 205 includes identifying additional criteria (e.g., as part of step 105) to facilitate providing a subterranean storage site location with a shale rock layer volume within which hundreds or thousands of tons of nuclear waste could be stored per storage borehole. For example, in some embodiments, identifying the subterranean storage site location (step 105) includes identifying a layer 210 having a thickness (e.g., minimum vertical thickness 235) of at least about 30.5 m (about 100 feet), and in some embodiments, at least about 305 m (about 1000 feet) and in some embodiments, at least about 1524 m (about 5000 feet). For example, in some embodiments, identifying the subterranean storage site location (step 105) includes identifying a layer having an areal extent (e.g., horizontal areal extent 410, FIG. 5) of at least about 404 ha (about 1000 acres), and in some embodiments at least about 2023 ha (about 5000 acres), and in some embodiments, at least about 4046 ha (about 10000 acres) and in some embodiments in a range from about 404 to 20234 ha (about 1000 to 50000 acres).

In some embodiments of the method 100, the identification of the subterranean storage site location 205 can include identifying further additional criteria (e.g., as part of step 105) e.g., to facilitate providing a subterranean storage site location 205 with a shale rock layer 210 depth 225 unlikely to be disturbed by surface phenomena (e.g., weather phenomena such as hurricanes or tornadoes, glacier or water movement, or manmade surface activity such as surface construction), and, below water tables and ground water. For example, in some embodiments, identifying the subterranean storage site location 205 (step 105) includes identifying a layer having an depth 225 of at least about 1524 m (about 5000 feet), and in some embodiments, at least 3048 m (about 10000) feet and in some embodiments, at least about 4272 m (about 15000 feet) from the earth's surface 214.

In some embodiments, the identification of the subterranean storage site location 205 (e.g., as part of step 105) includes examining geological and geophysical (e.g., acoustic) data recorded from previously drilled wells or from seismic exploration to find the shale rock layer having the fluid overpressure or other additional criterion (e.g., thickness 235, subterranean depth 225, and/or areal extent 410).

For instance, one skilled in the pertinent art would be familiar with the techniques used to locate potential geopressured oil and/or gas-containing shale rock layers. For instance, locations 205 having the expected fluid overpressure can be shale rock layers 210 containing significant quantities of organic matter that has been buried in the earth at temperatures that convert the solid organic matter to gas and oil over millions of years of time. The ability to such fluid overpressure shale rock layers 210 to confine such converted gas and oil matter for millions of years demonstrates the extremely low permeability of the layer and hence their desirability as a storage location 205 for nuclear waste.

For instance, one skilled in the pertinent art would be familiar with the techniques to examine geological and geophysical data for organic-rich shale layers, and to determine which shale layers have an elevated temperature history corresponding to a vitrinite reflectance (VR) of greater than 1. A VR of greater than 1 is indicative of organic matter that has been thermally altered into vitrinite crystalline particles having a high reflectivity. Organic-rich shale rock layers having a VR of greater than 1 are therefore indicative of rock formations having a temperature history sufficiently high to induce organic breakdown products and consequent fluid overpressure within the formation.

In some embodiments, only relatively small portions, e.g., 1.56 ha to 11 ha (one thousand to several thousand acres) of such intact organic rich fluid overpressured shale rock layers, e.g., which have not been rubblized (e.g., fractured) as part of oil or gas exploration or extraction activities, may be needed for nuclear waste storage as disclosed herein. To confirm the presence of the expected fluid overpressure in a candidate subterranean storage site location 205, the storage borehole 215 is formed (step 110) and the fluid pressure in the candidate storage borehole is actually measured (step 115).

For example, in some embodiments, as part of measuring the fluid pressure in the end segment 217 of the storage borehole 215 (step 115) can includes using conventional techniques to clean the borehole, run an open pipe to the end of the borehole 215, set an expandable packer around the pipe and measuring at the surface the pressure provided from fluid at the end of the borehole 215. One skilled in the pertinent art would be familiar with other techniques to measure fluid pressure in a borehole.

As further illustrated in FIGS. 1 and 2 embodiments of the method 100 can further include placing sensors 227 in the monitoring borehole 220 (or in each of the one or more monitoring boreholes 220) (step 140). For instance, the sensors 227 can be placed in the monitoring borehole 220 via an instrumentation tube 242 located in the borehole 220. The instrumentation sensors will be installed at pre-selected intervals within a continuous section of coiled tubing. As well understood by those skilled in the pertinent art, some varieties of sensor instrumentation can obtain readings through the casing and enclosing cement of the borehole 220 (e.g., radioactivity) whole other sensors can be positioned at perforations extending through the casing and cement of the borehole 220 into the surrounding rock formation of the layer 210.

As illustrated, in some embodiments, the sensors 227 are placed in the monitoring borehole 220 (step 140) before the nuclear waste 202 is stored in the storage borehole 215 (step 125), e.g., so that pre-storage baseline data can be collected from the sensors 227 for comparison to subsequent post-storage data collected by the sensors 227, and/or, so the monitoring via the sensors 227 can be done during nuclear waste storage (step 125). However, in other embodiments, the sensors 227 can be placed in the monitoring borehole 220 (step 142) after the nuclear waste is stored in the storage borehole 215 (step 125). In some embodiments, multiple sensors 227 can be positioned in the end segment 222 of the monitoring borehole 220, including, in some embodiments, positioning multiple sensors 227 along substantially the entire length of the end segment 222 such as illustrated in FIG. 2. In some embodiments, the data from such multiple sensors 227 can be pooled to provide a total or an average measure of the data collected by the sensors 227, while in other embodiments, the data from such multiple sensors 227 can be examined individually, e.g., to provide finer detailed spatial or temporal information from the data collected by the sensors 227. In some embodiments, the sensors 227 can be positioned facing towards and facing away from (e.g., sensors 227') the end segment 217 the storage borehole 215, e.g. to provide finer detailed spatial or temporal information from the data collected by the sensors 227, 227'.

In some embodiments, the sensors 227 can be configured to continuously or periodically (e.g., hourly, daily, weekly, monthly) collect temperature, pressure, gamma ray radiation or acoustic data in the vicinity of the storage borehole 215 (step 145) and to communicate the collected temperature, fluid pressure or gamma ray radiation data to a surface monitoring station 245 (step 150), e.g., in wired or wireless communication with the sensors 227. For example, temperature sensors 227 can provide information about temperature changes in the rock formation in the vicinity of the storage borehole 215 due to heat generated by the nuclear waste 202 stored in the storage borehole 215. For example, gamma ray sensors 227 can provide information about changes in radiation levels in the rock formation in the vicinity of the storage borehole 215 due radiation released from the nuclear waste from the storage borehole 215. For example fluid pressure sensors 227 can provide information about changes in the fluid pressure in the rock formation in the vicinity of the storage borehole 215 due to geologic changes in shale rock layer 210, e.g., from natural geological phenomena or from human activity. For example, sonic sensors 227 can provide acoustic information indicative of changes in the rock formation in the vicinity of the storage borehole 215 due to geologic changes in shale rock layer 210, e.g., from natural geological phenomena or from human activity. Based on the present disclosure, one skilled in the pertinent art would appreciate how other types of sensors could be included to collect other types of information about the environment surrounding the storage borehole 215.

In some embodiments, after storing the nuclear waste, the monitoring station is configured to create an alarm message (step 155) if any of the collected data indicates significant changes (e.g., 1 percent, 10 percent, 100 percent) relative to previously collected data, indicating the possibility of any disturbances of the storage site location 205, e.g., due to nuclear waste leakage or unauthorized efforts to remove the nuclear waste. In some embodiments what change considered to be sufficient to create the alarm message may be defined by a regulatory agency. In some embodiments, as part of creating the alarm message the message may be sent to a government agency or other entity given the custodial responsibly of monitoring the storage site location 205.

For example, in some embodiments, after storing the nuclear waste (step 102), the monitoring station 245 can be configured to create an alarm message (step 155) if the collected fluid pressure data (step 145) in the vicinity of the storage borehole 215, as measured by one of the sensors 227 falls to hydrostatic pressure or rises to lithostatic pressure. For example, in some embodiments, after storing the nuclear waste (step 102), the monitoring station 245 can be configured to create an alarm message (step 155) if the collected temperature data (step 145) in the vicinity of the storage borehole 215 as measured by the one of the sensors 227 increases by at least about one standard deviation as compared to an average temperature previously measured by the same one sensor 227 (e.g., measured prior to storing the nuclear waste or measured during a previous period of data collection after storing the waste 202). For example, in some embodiments, after storing the nuclear waste (step 102), the monitoring station 245 can be configured to create an alarm message (step 155) if the collected gamma radiation count data (step 145) in the vicinity of the storage borehole 215 as measured by the one of the sensors 227 increases by at least about one standard deviation as compared to an average collected gamma radiation count data previously measured by the same one sensor 227 (e.g., measured prior to storing the nuclear waste or measured during a previous period of data collection after storing the waste 202). For example, in some embodiments, after storing the nuclear waste (step 102), the monitoring station 245 can be configured to create an alarm message (step 155) if the collected acoustic data (step 145) in the vicinity of the storage borehole 215 as measured by the one of the sensors 227 increases by at least about one standard deviation as compared to an average collected acoustic data reading previously measured by the same one sensor 227 (e.g., measured prior to storing the nuclear waste or measured during a previous period of data collection after storing the waste 202).

FIG. 3 presents a cross-sectional view of an example storage borehole 215 embodiment of the waste storage system 100 similar to the system disclosed in the context of FIG. 2. In some embodiments of the method 100, forming the storage borehole 215 (step 110) includes drilling through an overlying rock formation 212 into the layer 210 to form a borehole 310, forming a casing 320, e.g., an about 0.10 to 0.15 m (about 4 to 6 inch) thick cylindrical stainless steel casing for some embodiments) in the borehole 310 and injecting cement 330 between the borehole 310 and the casing 320 to thereby bond the casing 320 to rock formations of the layer 210 that surround the borehole 310. Including cement as part of the storage borehole 215 can facilitate filling any crevices in the rock formation with the cement, e.g., to close off potential waste leakage routes from the borehole 310. Including the casing 320 as part of the storage borehole 215 can facilitate the introduction of waste 202 in the void 340 inside the casing 320.

Embodiments of the monitoring borehole 220 could be formed similar to that described above and the monitoring borehole 220 could include similarly include a casing bonded to the rock formation of the layer 210 surrounding the monitoring borehole 220.

In some embodiments, the void 340 inside the casing 320 of the storage borehole 215 has a diameter 345 of at least about 12 inches, and in some embodiments a diameter 345 in a range from about 0.25 to 0.91 m (about 10 to about 36 inches). A 0.40 m (about 16 inch) long length of the storage borehole 215 having a void diameter 345 of about 0.30 m (about 1 foot) has a void volume of about 0.028 cubic m (about 1.047 cubic feet). A 1.6 km and 3.2 km (1 and 2 mile) length of the end segment 217 of the storage borehole 215 having a void diameter 345 of about 0.30 m (about 1 foot) would have potential waste storage volumes of about 117 $m^3$ and 235 $m^3$ (about 4147 and about 8294 cubic feet), respectively.

To demonstrate the storage potential of one storage wellbore 215, consider a 1000 MWe nuclear reactor that generates about 20 $m^3$ (27 tonnes) of used nuclear fuel per year. One end segment 217 of the storage borehole 215 having waste storage volumes of 4147 and about 8294 cubic feet could store the yearly used nuclear fuel production of about 6 or 12 such nuclear reactors, respectively.

The potential waste storage volumes of the storage wellbore 215 can be dramatically increased by increasing the void diameter 345 of the storage borehole 215. For instance, a two mile length of the end segment 217 of the storage borehole 215 having a void diameter 345 of 0.61 and 0.91 m (2 and 3 feet) would have potential waste storage volumes of about 939 $m^3$ and 2113 $m^3$ (about 33175 and 74644 cubic feet), respectively. This would accommodate the yearly used nuclear fuel production (e.g., about 20 $m^3$ per reactor) of about 47 and 105 of such nuclear reactors, respectively.

Alternatively or additionally, to increase the potential waste storage volume of the storage site location 205, each storage borehole 215 can be lengthened to three miles, to four miles, etc. with incremental costs and/or can be formed with multiple end segments 217. For instance, in some embodiments of the method 100, forming the storage borehole 215 (e.g., as part of step 110) can include forming a storage borehole vertical portion 260 into the layer 210 and forming one or more storage borehole lateral portions 265 (e.g., horizontal boreholes) extending from the storage borehole vertical portion 260, where the end segment 217 of each storage borehole lateral portion 265 is within the layer 210.

For instance, FIG. 4 presents an overhead plan view an example waste storage system 200 similar the system disclosed in the context of FIG. 2 and further depicts eight storage borehole lateral portions 265 extending from the storage borehole vertical portion 260. As illustrated, the storage borehole lateral portions 265 can extend in different directions from each other and from the storage borehole vertical portion 260. As illustrated, all of the storage borehole lateral portions 265 have end segments 217 that are within the areal extent 410 of the layer 210. Eight such storage borehole lateral portions 265 each having a void diameters of 0.61 and 0.91 m (2 and 3 feet) would have potential waste storage volumes of about 7512 $m^3$ and 16904 $m^3$ (about 265400 and 597152 cubic feet), respectively, and therefore could accommodate the yearly used nuclear fuel production of about 376 and 840 such nuclear reactors, respectively.

In some embodiments, to help insure that each of the end segments 217 are undisturbed by activity at another end segment (e.g., forming boreholes, storing or removing waste at the other end segment), the end segments 217 each of the storage borehole lateral portions 265 can be separated from each other by distance 415 of at least about 305 m (about 1000 feet) and in some embodiments by at least about 610 m (about 2000 feet). In some embodiments, each of the storage borehole lateral portions 265 have end segments 217 of same lengths 420 (e.g., all segments 217 having same lengths 420 of about 30.5, 305, 1524, 3048, 4572 m (about 100, 1000, 5000, 10000 or 15000 feet), although in other embodiments the end segments 217 can have different lengths 420, e.g., to facilitate more efficiently use the available space within an irregular shaped areal extent 410 of the layer 210.

In some embodiments, e.g., where the storage borehole 215 has a plurality of the storage borehole lateral portions 265, there can be a plurality of monitoring boreholes 220 each one in a vicinity of the one of the end segments 217. Alternatively, it can advantageous to form a single monitoring borehole 220 but with a plurality of monitoring borehole lateral portions. For instance, in some embodiments of the method 100, forming the monitoring borehole 220 (e.g., as part of step 120) can include forming a monitoring borehole vertical portion 270 into the layer 210 and forming one or more monitoring borehole lateral portions 275 (e.g., horizontal monitoring boreholes) extending in different directions from the monitoring borehole vertical portion 270. As illustrated in FIGS. 2 and 4, the end segment 222 each one of the monitoring borehole lateral portions 275 can be located about parallel to and in the vicinity of the end segment 217 of one of the storage borehole lateral portions 265 and the end segment 222 each one of the monitoring borehole lateral portions 275 can be within the layer 210.

In some embodiments, as illustrated in FIG. 2, the monitoring borehole vertical portion 270 can be drilled (e.g., using substantially the same procedures as used to form the storage borehole) to a shorter depth 280 than a depth 282 of the storage borehole vertical portion 260, e.g., about 1.5 to 305 m shorter depth, or about 3.05 or about 6.1, about 30.5, or about 61 m (about 5 feet to about 1000 feet shorter depth, about 10, or about 20, or about 100, or about 200 feet) shorter depth. Each of the monitoring borehole lateral portions 275 can accordingly be at shorter depths 280 than the depth 282 of the corresponding one storage borehole lateral portion 265 that the one monitoring borehole lateral portion 275 is in the vicinity of.

In some embodiments, such as illustrated in FIG. 2, the lateral storage borehole portions 265 can extend from an end 290 of the vertical storage borehole portion 260. In other embodiments however the storage borehole lateral portions 265 can additionally or alternatively extend from a middle location(s) 292 of the vertical storage borehole portion 260 that is still in the layer 210.

Alternatively or additionally, in some embodiments, the subterranean storage site location 205 could further include a plurality of separated ones of the storage boreholes 215 in the layer 210. For instance, depending on the thickness 235 and the areal extent 410 of the layer 210, a plurality of separately formed storage boreholes 215 can be formed into the layer 210, in accordance with step 110, with each storage borehole 215 being laterally or/and vertically separated from the locations of other storage boreholes 215 formed in the layer 210. As a non-limiting example, for an about 305 m (about 1000 foot) thick 235 layer 210, multiple storage boreholes 215 could be formed at different depths 282 in the same areal extent 410, e.g., with each storage boreholes 215 being vertically separated from the nearest adjacent storage boreholes 215 by at least about 6.1, or about 30.5, about 61 m (about 20, or about 100, or about 200 feet) and laterally separated from the nearest adjacent storage boreholes 215 by at least about 30.5, or about 61, or about 152 or about 305 m (about 100, or about 200 or about 500 or about 1000 feet).

Based on the present disclosure, one skilled in the pertinent art would appreciate how corresponding monitoring boreholes 220 could be formed, in accordance with step 120, at each of the corresponding different depths 280 (e.g., shorter or longer than the depth 282 of one of the storage boreholes 215) such that end segments 222 of each of the monitoring boreholes are in the vicinity of the end segment 217 of one of the storage boreholes 215 and/or lateral separations from the nearest adjacent monitoring boreholes 220.

In some embodiments of the method 100, storing the waste (step 125) can further include lowering a canister, or multiple canisters, containing the nuclear waste 202 into the end segment 217 of the storage borehole 215 (step 160). For example the original containers of spent nuclear waste can be conveyed in individual canisters, if desired to the storage location 205 and then stored in the wellbore 215 in these original containers. For example, stainless canisters (e.g., canister 510 FIG. 5) can be lowered down the wellbore 215 by a drill pipe, with the passage of the canister being buoyed and lubricated by drilling mud as it is lowered, e.g., to the end segment 217. Having the canister being buoyed by the drilling mud mitigates the possibility of the canister being broken, e.g., by being dropped or falling down the storage borehole 215. For instance, the canister's 510 diameter 515 can be adjusted relative to the void diameter 345 to produce a gap distance 517, e.g., about 0.025 to 0.051 m (about 1 or 2 inches) between the canister 510 and the casing 320 to facilitate suspending the canister 510 by the buoyancy force of the drilling mud.

Alternatively, in some embodiments of the method 100, storing the waste (step 125) can further include pumping the waste into the storage borehole 215 with cement (step 165). For example, such embodiments can include (as part of step 165): disaggregating the nuclear waste into particles (e.g., average particle volume in a range of 10 mL to 1000 mL), mixing the disaggregated particles with cement to form a slurry and then pumping the slurry into the storage borehole 215 to the end segment 217 of the storage borehole 215, e.g., to form a cement plug holding the nuclear waste in the end segment 217.

Some embodiments of the method 100 can further include removing the stored nuclear waste 202 from the storage borehole 215 (step 170). For example, in some embodiments, the custodian of the storage site location 205, upon receiving an alarm message (step 155) may elect to remove the stored nuclear waste 202. Or, in some embodiments, the stored nuclear waste 202 may be removed, e.g., so that the waste 202 can be re-purposed or stored in a different location.

When the nuclear waste 202 is stored in canisters in the storage borehole 215, then the canisters can be removed (step 170) from the storage borehole 215 using a canister removal tool. FIG. 5 presents a perspective view of an example storage canister 510 and canister removal tool 520 to remove waste 202 from the waste storage system, similar to the system 200 disclosed in the context of FIG. 2. For example, in some embodiments, removing the stored nuclear waste 202 (step 170) from the storage borehole 215 can include (as part of step 172) running a canister removal tool 520, (e.g., a reconfigured overshot drill in some embodiments) inside the casing 320 of the storage borehole 215 and over the storage canister 510 that is fitted with longitudinal shims 530. For example, in some embodiments, the storage canister 510 can be fitted with three radially equidistant separated, easily millable, shims 530, e.g., recessed a few inches from the sealed end 535 of the canister 510, and running along the long axis, of the canister 510), to hold the canister 510 away from the casing wall surface 537 and to keep the canister 510 centralized within the casing 320, to thereby facilitate self-guiding of the removal tool 520 to surround and attach to the storage canister 510. For example, after milling out the surrounding cement and shims 530 via the removal tool 520 (e.g., via milling structures 540 located at about the end 545 of the tool 520), latches 550 of the tool 520 (e.g., one-way spring-loaded lugs situated around the inside surface at about the end 545 of the tool 520) could be controlled to open and engage with the storage canister 510 and then (e.g., as part of step 170) the tool 520 and the attached storage canister 510 could be removed from the storage borehole 215.

When the nuclear waste is stored as a cement plug in the storage borehole 215, then the cement plug entrained with the nuclear waste particles can be drilled out of the storage borehole 215. For example, in some embodiments, removing the stored nuclear waste 202 (step 170) from the storage borehole 215 can include (step 175): reentering the casing of the borehole 215 with a drilling bit, drilling out the cement plug with the drilling bit and circulating the content of cement plug to a surface location of the borehole 215.

Embodiments of the system 200 for storing and monitoring nuclear waste can include any of the features and variations as disclosed in the context of FIGS. 1-5.

As illustrated in FIG. 2, embodiments of the system 200 can comprise a storage borehole 215 having an end segment 217 configured to store nuclear waste 202 in a subterranean storage site location 205 having a shale rock layer 210, the layer 210 having a measured fluid overpressure in a range corresponding to greater than hydrostatic pressure to less than a lithostatic pressure from the overlying rock layers 212. Embodiments of the system 200 can also comprise a monitoring borehole 220 configured to reside in the layer 210 with an end segment 222 of the monitoring borehole in a vicinity of the end segment 217 of the storage borehole 215, wherein the measured fluid pressure at the end of the monitoring borehole 220 is in the fluid overpressure range.

As further illustrated in FIG. 2, in some such embodiments of the system 200, the monitoring borehole 220 can include sensors 227 configured to periodically collect temperature, fluid pressure and gamma ray radiation data in the vicinity of the storage borehole 215 and configured to communicate the data to a monitoring station 245 of the system 200.

As further illustrated in FIGS. 2 and 4, in some such embodiments of the system 200, the storage borehole 215 can includes a storage borehole vertical portion 260 in the layer 210 and one or more storage borehole lateral portions 265 extending from the storage borehole vertical portion 260 wherein the end segment 217 of each of the one or more storage borehole lateral portions 260 is within the layer 210. The monitoring borehole 220 can include a monitoring borehole vertical portion 270 in the layer 210 and one or more monitoring borehole lateral portions 275 extending in different directions from the monitoring borehole vertical portion, wherein the end segment 222 each one of the monitoring borehole lateral portions 275 are about parallel to and in the vicinity of the end segment 217 of one of the storage borehole lateral portions 265 and the end segment 222 each one of the monitoring borehole lateral portions 275 is within the layer 210.

As further illustrated in FIG. 3, some such embodiments of the system 200 can further include an overshot drill 520 configured as a canister removal tool, and, storage canister 510 fitted with longitudinal shims 530 (e.g., easy-drilling shims as familiar to those skilled in the pertinent art). The overshot drill removal tool 520 is configured to fit inside of a casing 320 of the storage borehole 215 and over the storage canister 510 so as to surround and attach to the storage canister 510. For example on withdrawing the overshot drill 520 (e.g., as part of step 172), one-way spring-loaded hooks can engage the canisters 510 for ready withdrawal.

Those skilled in the art to which this application relates will appreciate that other and further additions, deletions, substitutions and modifications may be made to the described embodiments.

The invention claimed is:

1. A system for storing and monitoring nuclear waste, comprising:

a storage borehole having an end segment configured to store nuclear waste in a subterranean storage site location having a shale rock layer, the layer having a measured fluid overpressure in a range corresponding to greater than hydrostatic pressure to less than a lithostatic pressure from overlying rock layers; and a monitoring borehole configured to reside in the layer with an end segment of the monitoring borehole in a vicinity of the end segment of the storage borehole, wherein the measured fluid pressure at the end of the monitoring borehole is in the fluid overpressure range.

2. The system of claim 1, wherein the monitoring borehole includes sensors configured to periodically collect temperature, fluid pressure and gamma ray radiation data in the vicinity of the storage borehole and to communicate the data to a monitoring station of the system.

3. The system of claim 2, wherein the monitoring station is configured to create an alarm message if the collected fluid pressure data as measured by at least one of the sensors in the monitoring borehole falls to the hydrostatic pressure or rises to the lithostatic pressure.

4. The system of claim 2, wherein the monitoring station is configured to create an alarm message if the collected temperature data as measured by at least one of the sensors in the monitoring borehole increases by at least about one standard deviation as compared to an average temperature previously measured by the same one sensor.

5. The system of claim 2, wherein the monitoring station is configured to create an alarm message if the collected gamma radiation count data as measured by at least one of the sensors in the monitoring borehole increases by at least about one standard deviation as compared to an average gamma radiation count previously measured by the same one sensor.

6. The system of claim 2, wherein the monitoring station is configured to create an alarm message if the collected acoustic data as measured by at least one of the sensors in the monitoring borehole increases by at least about one standard deviation as compared to an average acoustic data reading previously measured by the same one sensor.

7. The system of claim 1, wherein the storage borehole includes a storage borehole vertical portion in the layer and one or more storage borehole lateral portions extending from the storage borehole vertical portion wherein the end segment of each of the one or more storage borehole lateral portions is within the layer.

8. The system of claim 7, wherein the end segment of each of the one or more storage borehole lateral portions have a waste storage volume in a range from about 117 $m^3$ and 2113 $m^3$.

9. The system of claim 7, wherein the end segment of each of the one or more storage borehole lateral portions are separated from each other by distance of at least about 305 m.

10. The system of claim 7, wherein the end segment of each of the one or more storage borehole lateral portions have a length in a range from about 30 to 4572 m.

11. The system of claim 7, wherein the monitoring borehole includes a monitoring borehole vertical portion in the layer and one or more monitoring borehole lateral portions extending from the monitoring borehole vertical portion, wherein the end segment each one of the monitoring borehole lateral portions are about parallel to and in the vicinity of the end segment of one of the storage borehole lateral portions and the end segment each one of the monitoring borehole lateral portions is within the layer.

12. The system of claim 1, wherein the layer of the subterranean storage site location has:

a thickness of at least about 100 feet, a subterranean depth of at least about 5000 feet, and an areal extent of at least about 1000 acres.

13. The system of claim 1, wherein the layer has a vitrinite reflectance of greater than one.

14. The system of claim 1, wherein a plurality of separated ones of the storage boreholes are in the layer.

15. The system of claim 1, further including one or more a storage canisters, wherein the nuclear waste stored in each of the canisters is located in the end segment.

16. The system of claim 1, wherein each of the one or more canisters is fitted with radially equidistant separated, millable shims running along the long axis of the canister, the shims configured to hold the canister away from a casing wall surface of the storage borehole.

17. The system of claim 16, a canister removal tool configured to fit within the casing wall and surround the one canister, the tool including:

milling structures configured to mill cement surrounding the canister and the shims of the canister, and latches configured to open and engage with the storage canister.

18. The system of claim 1, wherein the nuclear waste stored in the storage borehole is stored as a cement plug entrained with particles of the nuclear waste and located in the end segment.

* * * * *